US010160558B2

(12) United States Patent
Stork

(10) Patent No.: US 10,160,558 B2
(45) Date of Patent: Dec. 25, 2018

(54) HIGH SPEED VERTICAL FILM WRAPPING AND SEALING MACHINE

(75) Inventor: Brian R. Stork, Washington, MO (US)

(73) Assignee: TEXWRAP PACKAGING SYSTEMS LLC, Washington, MO (US)

( * ) Notice: Subject to any disclaimer, the term of this patent is extended or adjusted under 35 U.S.C. 154(b) by 1186 days.

(21) Appl. No.: 13/466,601

(22) Filed: May 8, 2012

(65) Prior Publication Data

US 2013/0014476 A1 Jan. 17, 2013

Related U.S. Application Data

(60) Provisional application No. 61/518,922, filed on May 13, 2011.

(51) Int. Cl.

| | |
|---|---|
| ***B65B 65/00*** | (2006.01) |
| ***B65B 9/067*** | (2012.01) |
| ***B65B 21/24*** | (2006.01) |
| ***B65B 51/30*** | (2006.01) |

(52) U.S. Cl.

CPC ..... *B65B 9/067* (2013.01); *B65B 21/245* (2013.01); *B65B 51/306* (2013.01)

(58) Field of Classification Search

CPC ..... B65B 2220/10; B65B 2051/10; B65B 65/003; B65B 61/08; B65B 61/10; B65B 59/04; B65B 53/02; B65B 51/306; B65B 51/16; B65B 59/06; B65B 59/067

USPC .. 53/550, 374.3, 374.4, 374.5, 374.6, 375.4, 53/557, 442, 511, 433, 53

See application file for complete search history.

(56) References Cited

U.S. PATENT DOCUMENTS

| | | | | |
|---|---|---|---|---|
| 3,590,549 | A * | 7/1971 | Zelnick | 53/442 |
| 3,640,048 | A * | 2/1972 | Zelnick | B65B 9/026 206/386 |
| 4,272,944 | A * | 6/1981 | Suga | 53/511 |
| 4,549,388 | A * | 10/1985 | Lancaster | B65B 51/225 53/210 |
| 5,014,496 | A * | 5/1991 | Davis et al. | 53/433 |
| 5,378,304 | A * | 1/1995 | Denker | B29C 65/18 100/154 |
| 5,444,964 | A * | 8/1995 | Hanagata | B29C 65/7439 156/324 |

(Continued)

*Primary Examiner* — Andrew M Tecco
*Assistant Examiner* — Chelsea Stinson
(74) *Attorney, Agent, or Firm* — Thompson Hine LLP

(57) ABSTRACT

A selectively reconfigurable wrapping machine [A] for sequentially wrapping upright products. An infeed conveyor carries products to a wrapping station module where a tube of shrink-wrap material, pulled from rolled storage [B], is formed about the products by a film directing and tracking module generally designated [C] by use of a film plow [D]. Marginal edges of the shrink-wrap material are joined by a selectively configurable bottom seal module [E] which pulls the tube in to form a selectively positionable longitudinal bottom seal. A film sealing and cutting module [G] has opposed sealing heads [G2L, G2R] carried to face each other with fixed angular orientation such that the heads travel with products in the tube for a distance as it moves giving sealing dwell time for nonstop operation. A microprocessor-driven control system provides user setup controls.

9 Claims, 15 Drawing Sheets

(56) References Cited

U.S. PATENT DOCUMENTS

| | | | | |
|---|---|---|---|---|
| 5,603,801 | A * | 2/1997 | DeFriese | B29C 65/7439 156/251 |
| 5,761,878 | A * | 6/1998 | Walkiewicz, Jr. | B29C 65/18 156/515 |
| 5,956,931 | A | 9/1999 | Stork | |
| 6,526,728 | B1 * | 3/2003 | Sorenson | B29C 65/229 53/373.5 |
| 6,622,767 | B2 | 9/2003 | Stork | |
| 6,854,242 | B2 * | 2/2005 | Stork et al. | 53/53 |
| 7,082,979 | B2 | 8/2006 | Stork | |
| 7,174,697 | B2 * | 2/2007 | Hada | B65B 9/067 53/141 |
| 7,637,299 | B2 * | 12/2009 | King, Jr. | B26D 1/0006 156/251 |
| 8,651,162 | B2 * | 2/2014 | Christman | B29C 65/18 156/553 |

* cited by examiner

HIGH SPEED VERTICAL FILM WRAPPING AND SEALING MACHINE

CROSS-REFERENCE TO RELATED APPLICATION(S)

This application is based upon and claims the priority of U.S. provisional patent application Ser. No. 61/518,922, filed 13 May 2011, by the present inventor, and which provisional application is incorporated by reference into the present application.

TECHNICAL FIELD

The present invention relates to film wrapping and sealing, and specifically to so-called shrink-wrapping machines for that, and more particularly, to a high speed film wrapping and sealing machine or so-called shrink-wrapping machine for continuous-operation sequential packaging of objects (or other articles, products or items) as packages by which the packages are fully enveloped and sealed in heat-sealable polymeric film as the objects are conveyed upright, that is, vertically, through the machine.

More specifically, the inventive apparatus is in the field which generally relates to fully automated shrink wrap and/or film wrap equipment including servo wrappers, high speed wrappers, horizontal modular sealers, L-sealers, intermittent motion modular sealers, tunnels and conveyors. This field is different from machines and films used for stretch-wrapping involving forced stretching of film.

By use of an automated machine of this invention, products, objects or other items, as may be oriented upright, become automatically fully enclosed within the film material, which may or may not be of heat shrinkable, as they are carried by conveyor through an automated machine of the invention and are sealed within the material without stopping during sealing and cutting of the film material, and wherein the film material is sealed by a sealing module as film material envelops the products, objects or other items.

A modular sealer of the disclosed type is apparatus used in packaging machinery, such as a packaging machine in which packages move along a conveying surface and are enveloped in film as they are conveyed along a linear path where there are layers of film above and below the packages and so envelop them with film overlap along the bottom of the packages, because as articles to be packaged are moved on a conveyor, the film is folded around the periphery of the successive articles and the opposing edges of the film material overlap and extend beneath the article.

A need has existed for a high-speed automated sealing system capable of rapidly and accurately handling and wrapping upright containers, as with heat shrinkable and/or heat sealable film material, instead of wrapping horizontally oriented packages or products.

Another need for improvement in film wrapping of products is to allow sealing of different types of bottom seals as well as to allow selective location or relocation of bottom seals when upright containers or products are sealed in film.

In such packaging machinery used for shrink wrapping of packages, namely a commercial shrink-wrap machine, multiple stages of processing may occur. Elongate sealing of the film material is a key processing stage in such a machine. It should be carried out with reliability and over a possible wide range of speeds, including high speed or low speed, and be able to be carried out over a wide range of materials such as those noted, and preferably without frequent attention after it has been satisfactorily established for use with a given type and composition of film.

In a shrink-wrap machine, there may occur stoppage or slowing of a conveyor carrying packages and film material to be sealed about the packages. Such stoppage or slowing may not be related to the side sealing, for it may be caused by other factors. Even so, the modular sealer for such a shrink-wrap machine preferably should be able to operate extremely well even though such stoppage or slowing may take place, and without damage to the film material which has passed through or is passing through the modular sealer or, for that matter, has stopped while passing through the modular sealer.

BACKGROUND AND SUMMARY

Co-assigned U.S. Pat. No. 6,854,242, sharing inventorship of one or more inventors in common with the present invention, discloses a modular shrink-wrap machine (for use with a loading device for individually wrapping products sequentially with shrink-wrap material as product packages are delivered in sequence to the machine. U.S. Pat. No. 6,854,242 ("the '242 patent") is incorporated by reference in the present patent application. In the '242 patent, film material is delivered from a roll at a wrapping station. Product packages are carried flat into the machine, enveloped in the film in a wrapping station and then carried into a film sealing and cutting station. Film sealing and cutting apparatus has upper and lower heads, an upper one being which is driven into and out of engagement with the lower other between adjacent wrapped the horizontally-oriented products received by the first conveyor for effecting a sealed cut between them. A side seal-forming arrangement seals side edges of the film material along one side of the products by heat sealing to provide a side seal. Microprocessor-driven touch screen and software-driven systems controls the shrink-wrap machine.

Reference is made also to co-assigned Stork U.S. Pat. No. 5,956,931 ("the '931 patent"), wherein named inventor Brian R. Stork is inventor Brian R. Stork of the present invention. That patent shows an apparatus for wrapping products in which products are provided to a delivery input conveyor, wrapped in a tube of heat-sealable material, and to a sealing station wherein horizontally-extending sealing heads are brought into and out of engagement with a tube to cut and seal the plastic, i.e., film material forming the tube. The products, delivered as wrapped packages onto an exit conveyor, proceed into a heat-shrink station for final processing and discharge. That patent describes an arrangement for positioning and movement of the sealing heads which can be adjusted, as by operator input. Movement of the head is detected by an electric eye which determines relative dimensions of the product for initiating appropriate movement of the sealing head or heads.

A machine of the present invention employs advantageous modular components for handling, sealing and cutting of the packages and the film material.

The presently inventive machine operates such that movement of packages is not interrupted during sealing and cutting of a formed tube enveloping the packages, because sealing and cutting is carried out by orbitally-reciprocating sealing heads so that these operations take place "on the fly" for attaining high speed operation with outstanding throughput.

A new machine of the presently inventive system employs modular components, which are arranged very differently from those of the referenced patents to provide extraordinary vertical product wrapping with effects and advantages and provide a range of adjustment, accommodation, positioning, and selective use, speed and throughput which is astonishing and remarkable.

For controlling these modular components and the conveying of products into and through the new apparatus, computer software programs for controlling-wrap machine operation wherein software can provide operator input to define movement of sealing heads and other characteristics appropriate to the type of sealing operation to be carried out, generally as in the '242 patent.

In the new apparatus, vacuum conveyors are employed to maintain a product or group of group of products in vacuum conveyor tractive adherence, while wrapped in a tube of sealing material, and while the product is brought to and into and through sealing position(s).

Prior art arrangements have not fully achieved the efficiency, speed and throughput or ease of adjustment and change desired by customers, nor have they been suitable for film wrapping of product packages such as cylinder-shaped containers or products which are oriented upright and are preferably to be maintained upright during wrapping and sealing. Until now, such containers have had typically to pass through packaging machines in a horizontal orientation, or have required pausing of operation while wrapping and shrinking took place. So also, prior art arrangements have restricted locations and types of edge or bottom seals for so-shaped containers or products.

In comparison, novel and effective apparatus of the invention provides uniquely effective film wrapping of upright items, namely those vertically oriented, such as tubes, rolls, bottles, cans, tall containers, detergents, paper towels, cleaning agents, composite cylinders, vertical stacks, and typical containers of caustics, bleaches, other chemicals and powders, cleaners, spray containers, lawn care and garden compositions, paint cans, solvents, and myriads of grocery supplies and foods, as well as hardware store consumer items, and, without limitation, other upright containers and objects too numerous to completely list.

In other words, the present wrapping system allows wrapping of upright objects or products, so that it is not necessary for such items to be conveyed horizontally, or placed flat or on their sides for sealing in film material. So also, it will be appreciated that some conveyors are often best used and adapted for handling only vertical containers such as cans, rolls, bottles and packages. Some items can be are normally best handled in upright configuration. Because such items can pass through the new wrapping machine in an upright orientation, not only can they be presented upright by such conveyors but also they may be presented to the machine in different package heights. It is now found that high speed and throughput can, after all, be achieved in a film wrapping and sealing machine of the invention by allowing continuous-operation sequential packaging of the upright items and/or variously-sized products to take place so that their movement is not interrupted during sealing and cutting. Pauses for each such item are not now required in operation of the inventive apparatus. The new machine employs for this purpose a special sealing module that uses orbitally-reciprocating sealing heads which move laterally at the sides of upright containers or products for high speed on-the-fly operation, while a bottom-seal special module or system creates a single bottom seal below the upright containers or products of desired location and type. These modules provide selective adjustable and precisely controlled movement of sealing-and-cutting heads as they are brought into and out of engagement with a tube of film material that wraps a product.

Wrapping of products is carried out in the inventive apparatus so as to form improved and markedly better portions or points of seal-termination or union of sealed film of the products after they are wrapped, so that objectionable dimples, film pockets, gussets, "ears" or "tucks" do not result.

Among the various advantages, benefits, notable features, goals and objectives of machines of the invention are these, summarized in part briefly as follows:

An advanced automated wrapping machine is provided to satisfy very demanding industrial packaging applications.

The new machine combines servo technology, PLC control and machine mechanics into an optimized unit having configurable vertical and bottom seal modules.

A novel film plow system of the new machine minimizes film usage and facilitates loading and operation.

The new automated wrapping machines of the invention can handle the automated continuous wrapping many different types of products, having a range of widths, heights and shapes which have capability or need for being quickly film-wrapped.

Various types of film material, including plain or preprinted, shrink type, sealable type, and with different possible axial orientations (directions) of shrinkage, if any, and different strength characteristics, can be used in the new automated film wrapping equipment.

By way of example, the film material may be of various possible thicknesses and various possible compositions, and may be light, medium or thick, tough film which can be considered difficult to cut such as those in a class of superlative very strong new heat-sealable film materials (referred to this application as the "tough film materials" or the "new tough film materials"), e.g., as sold under the brands Cryovac® and CorTuff® made by Sealed Air Corporation, that are extremely strong and tough, providing very high impact and cutting protection. Such materials are strong enough and sufficiently protective that they can function as primary shipping containers without more, and may be used as an alternative to corrugated boxes to provide packaging and shipping cost reductions. However, these new tough film materials are more difficult to cut and seal than conventional shrink-wrap film materials but can be handled by the new machine.

Equipment of the invention provides a high degree of both mechanical and electrical changeability for providing modular characteristics, by which both mechanical and electrical features can be changed by the substitution of modules or by software-implemented changes under the control of an operator.

Product packages can be provided directly to the film wrapping machine by an infeed conveyor upon which the packages are upright, that is, upstanding, and remain so as they undergo automated wrapping in the machine.

Continuous-operation sequential packaging of the upright product packages and/or variously-sized products to take place so that their movement is not interrupted during sealing and cutting.

Both vertical sealing operations and longitudinal bottom-sealing operations are carried out by modular component units which are individually accessible and easily adjusted or serviced.

Many types of modular longitudinal seal systems are available: static seal, fin seal, seal-and-trim, positive lap, and other variations.

Film is formed into a product-enveloping tube enclosure by fixed or adjustable film formers [that is, tube formers] of novel configuration.

Servo operation is provided under supervision of programmable logic controller control.

Software control is provided including operator display that can be selectively oriented or repositioned, and the software features provide product setup library to save and recall machine settings. As a further advantage, machine set-ups can be saved to user defined alphanumeric product codes for extreme convenience.

"Tool-less" set up is provided by such software control. Sealing member settings and other operations limits and operating characteristics are automatically adjusted through touch-screen for the operator.

The software-driven control system provides a user-friendly set-up program to aid a novice operator and includes touchscreen diagnostics for troubleshooting and color touchscreen control operation.

The software-driven control system also provides a user-defined alarm system with audible/visible warning.

Mating to various types of infeed conveyors is provided, such as servo-driven starwheel types.

A variable speed exit conveyor is provided for improved exit handling of wrapped products.

Film roll monitoring is provided (e.g., film low warning, film out automatic stop).

Ambidextrous design allows for left or right hand machine user operation

Product packaging conveyor and sealing speeds are adjustable over a large range, and allow operation to a high packaging rates.

Unique end-seal head design keeps blade & pad vertical through entire range of motion.

As a brief overview, the present apparatus is a selectively reconfigurable shrink-wrap machine for sequentially wrapping products which are delivered sequentially by the loading device in upright condition. Shrink-wrap material is delivered from roll storage at a wrapping station. The products may be wrapped individually or in groups. An infeed conveyor carries products to be wrapped at a tube wrapping station. As a tube of the shrink-wrap material is formed about the products by being pulled from rolled storage, marginal edges of the shrink-wrap material are joined by a selectively configurable bottom seal module, to form a bottom seal. Upright products-within the tube, which tube is now bottom sealed, are delivered to a film sealing and cutting apparatus. The film sealing and cutting apparatus has laterally opposed sealing heads. The sealing heads have upright sealing surfaces and are pivotally carried by top and bottom planetary gearheads. Above and below the jaws are top and bottom planetary gearheads that carry the jaws, that is, sealing heads, which are pivoted for movement on an axis eccentric to that of the gearheads, so that the heads always face each other with fixed angular orientation, but providing orbital movement toward and away from tube-enveloped products as well as movement along with the tube-enveloped products so that the heads travel a distance in an opposed sealing relation as the tube of products moves through the machine. This provides during sealing an appropriate sealing "dwell time" during which sealing between successive packages occurs. An outfeed conveyor delivers the products or groups of them after being so wrapped and sealed. A microprocessor-driven control system has touch sensitive viewing and controlling controls for prompting and receiving operator response for controlling operation of the shrink-wrap machine.

The inventive new apparatus provides for different types of bottom seals by the use of a sealing module that allows, just as an example, "bottom" seal placement that does not interfere with markings, brand indicia or text or designs which are to be legible on the products after they are wrapped.

For forming such a bottom seal for upright products or items or a discrete group of multiple such upright products or items, the present invention more specifically provide a modular bottom sealer system that receives and seals a single sealing edge at which a tube of the wrapped sealing material converges to be sealed, and can trim off a narrow strip of film is cut from the overlapped film material during formation of the bottom seal. The modular bottom sealer cuts and seals the terminal edges of overlapped or butted sheets of shrink-wrapping film material by thermally cutting the material and pressure-sealing the cut sheets on one side of the overlapped sheets. This new modular bottom sealer is capable of producing many types of seals, as noted previously, beneath the products. Further, it can be selectively and adjustably positioned so as to locate the resultant longitudinal seal at a desired central, off-center or laterally-placed location, and such is highly advantageous.

A brief overview of the modular bottom sealer is helpful. It produces a selectively laterally positionable bottom seal by cutting and sealing opposing surfaces of overlapped shrink film material so they are bonded together by application of heat and pressure applied on opposing right and left margins of a tube formed of the film material as the film material containing film-wrapped articles is pulled by the modular sealer through the modular sealer. The modular sealer has a chassis having right and left belt-and-pulley sections. A heated blade assembly of the upper section cuts the film material and cooperates with right and left twin V-belts assemblies of the belt-and-pulley sections, which provide clamping pressure, to achieve bottom sealing of the film material. The modular sealer has provision for being driven mechanically by the packaging machine.

Other features will be in part apparent and in part pointed out below.

BRIEF DESCRIPTION OF THE DRAWINGS

FIG. 1A is a perspective view of the machine in its entirety.

Corresponding reference characters indicate corresponding parts throughout views of the drawings.

DESCRIPTION OF PRACTICAL EMBODIMENT(S)

Referring to FIGS. 1A and 1B, an automated film wrapping machine of the invention comprises a machine framework generally designated A, a film supply apparatus generally shown at 13 extending laterally from the framework, a film directing and tracking module generally designated C provides in effect what is a film dispensing station. This module or station includes a plow assembly D, by which film unrolled from a film cradle is formed for wrapping about products, a bottom seal modular assembly (and can be also be called a bottom seal module) E, a vacuum conveyor assembly F, a vertical sealing and cutting modular assembly (that can also be called a vertical seal module) generally shown at G, which also of modular character, and an outfeed conveyor generally shown at H. The film-handling mechanism B and plow assembly D together provide a wrapping station at which to form a film tube around the upright packages and to orient the tube so that the film edges are joined by the bottom seal module E to provide a longitudinal seal, as of lap or fin type or other desired type, and having desired lateral position.

To these basic elements of an automated film wrapping machine of the invention can be added various components useful for a specific installation. For example, the film wrapping machine can be mated to a wide variety of loading devices including infeed conveyors heretofore known in the industry, such as a standard upstream feeder of segmented or position-defining or having auto-spacing elements or star wheels or other aligning or spacing or sequence-determining elements. Further, custom infeeds and outfeeds can be used with the new film wrapping machine.

Figure 1:
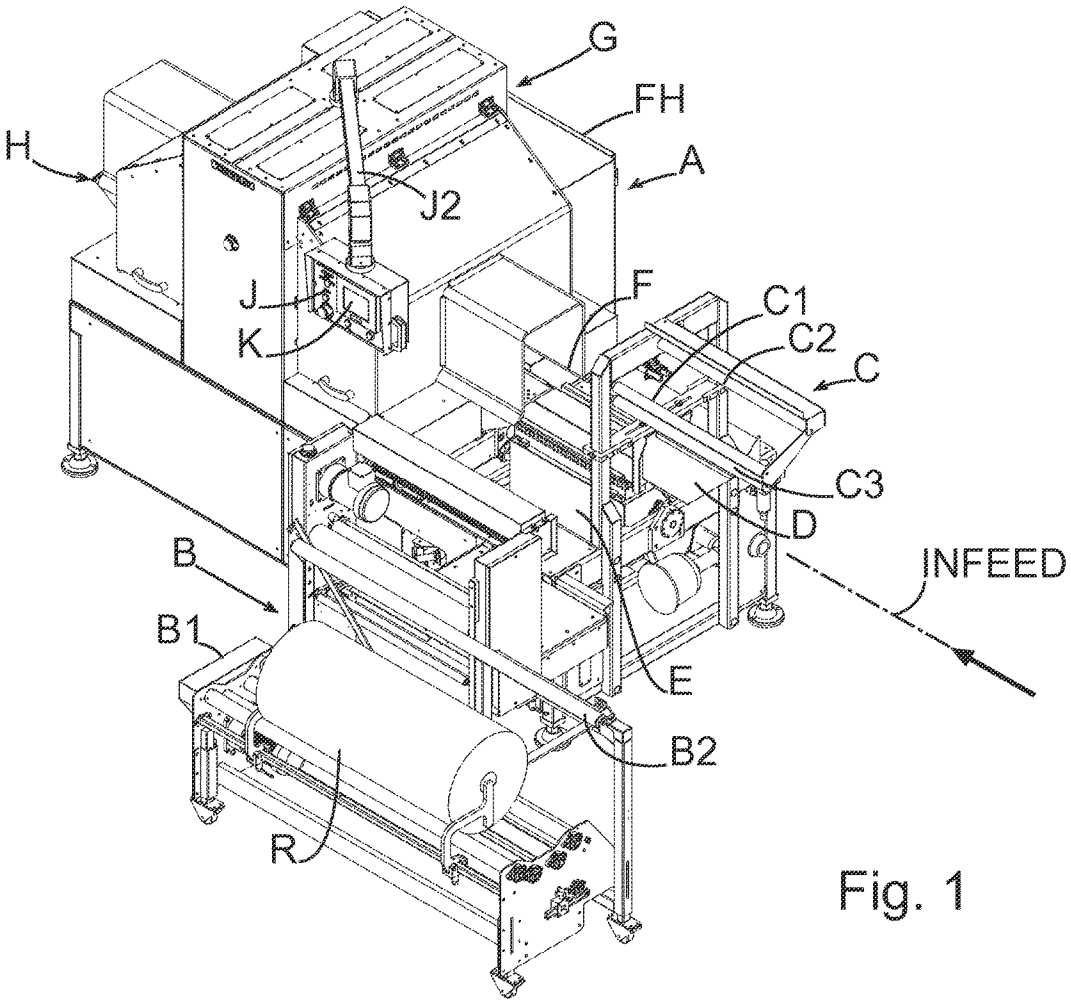
FIG. 1 is a perspective view of a automated shrink wrap machine, that is, a film wrapping machine for wrapping product packages, being apparatus in accordance with and embodying the present invention.
Figure 2:
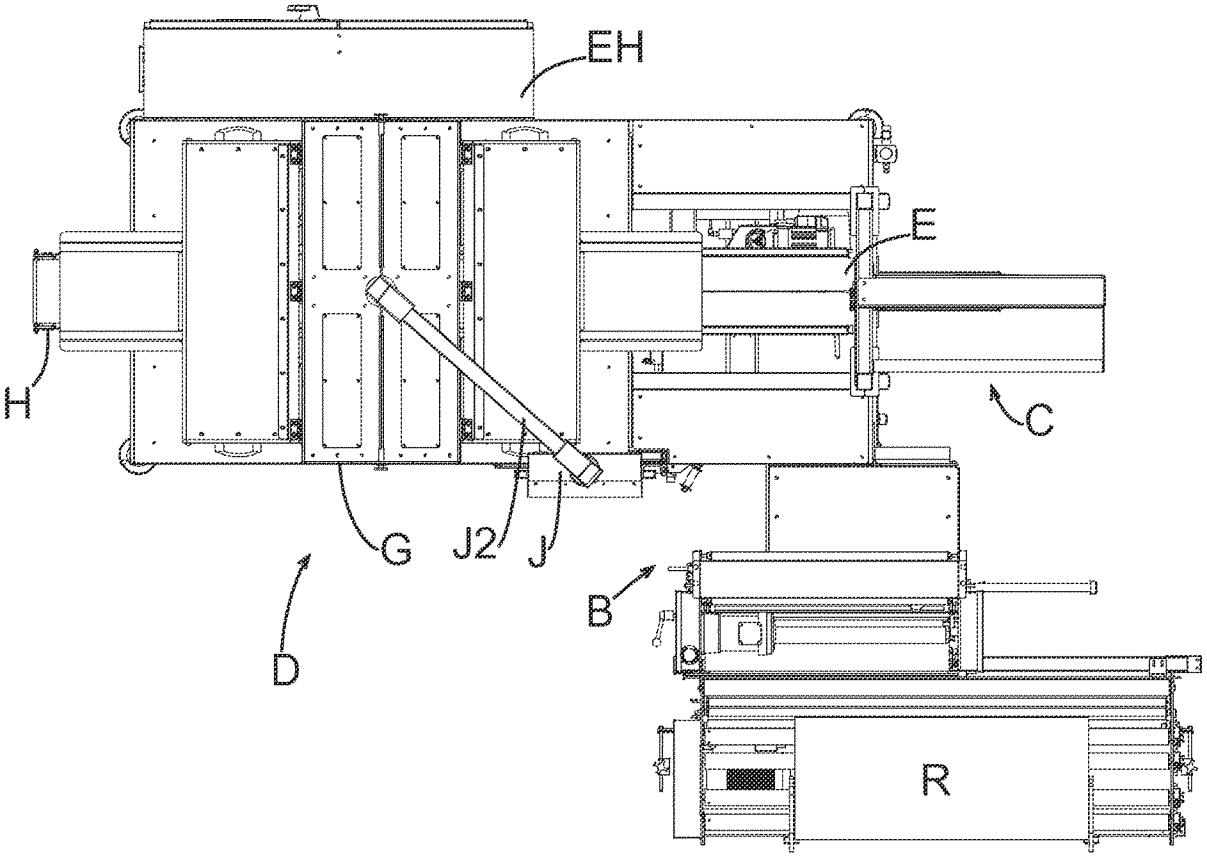
FIG. 2 is a top view of the machine of FIG. 1.

In addition to the elements and modules shown, shown in FIG. 1 is an operator control module J including a swivel touch screen K positionable by a swingable arm J2 for either right or left handed line operation. Control module J provides operator adjustment, control and monitoring. This provides an operator accessible microprocessor-driven control system having a touch sensitive viewing and controlling controls for prompting and receiving operator response for controlling operation of the shrink-wrap machine.

Referring still to FIGS. 1-4, film supply apparatus B includes a film roll cradle B1 which holds rolled film of type suitable for the intended packages, the roll R being typically as large in diameter as 18 in. Film, for example, of a single layer of continuous sheet material, passes over powered film unwind roller B2 and then to a film delivery and tracking system C1 comprising film guide rollers C2 and C3 which can handle single or double film feed by the film dispensing station C.

Film is guided by this arrangement to the plow assembly D which constitutes a film forming assembly that causes the film to be bent and thus folded into a longitudinal continuous tubular formation in which opposed marginal edges come together beneath the folded tube. The reader here may visualize the creation, thus far, of an endless tube for being pulled into the new sealing machine. Bottom seal module E, explained more fully below, provides tractive force by seizing the opposed longitudinal marginal film edges by traction rollers that will become evident from following explanation, and seals the film edges together.

Figure 12:
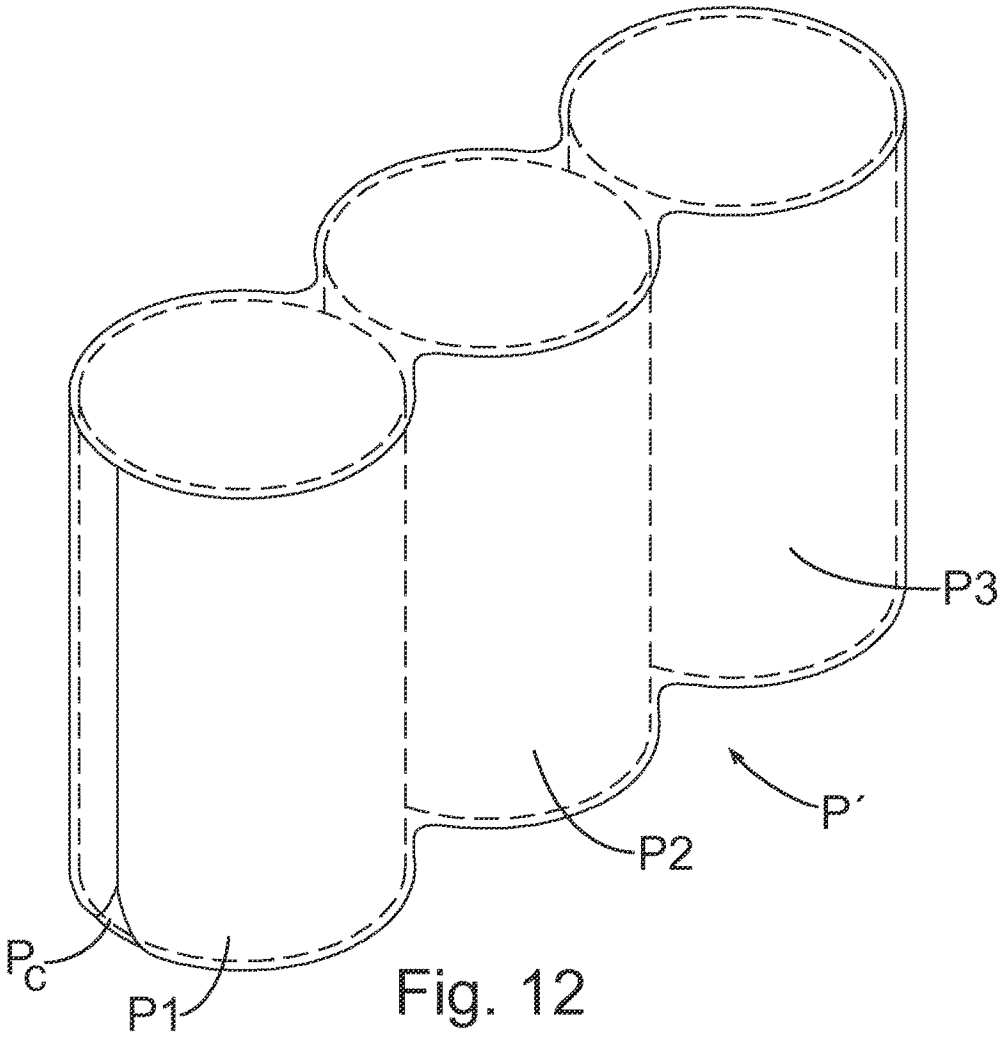
FIG. 12 is a view of a representative sealed package having several products which have been wrapped and sealed within the package as they passed in vertical orientation through the machine.

Although product packages are not shown in FIGS. 1-4, a representative sealed package P' having several products P1-P3 within it is shown in FIG. 12. Package P' has representative products P1-P3 sealed therein. An external infeed conveyor, here represented in phantom as an infeed axis by the designation INFEED, continuously supplies upright products or product containers or packages, such as rolls, bottles, cans, tall containers, detergents, paper towels, cleaning agents, composite cylinders, vertical stacks, and other types of upright containers or products. These upright products or product containers or packages pass into the plow assembly as film directed from the film guides roller is folded about them so that the visualized tube wraps and encompasses them to leave the longitudinal marginal film edges beneath the product-filled tube. That is, the film material is folded around the periphery of the successive articles and the opposing edges of the film material overlap and extend beneath the articles. The longitudinal marginal film edges can be selectively sealed, with desired preselected seal type, by the bottom seal module E, and with preselected lateral placement beneath the product-filled tube, so as to create a continuous longitudinal bottom seal. An excess marginal seal portion is trimmed by bottom seal module E.

The product-filled tube, with its bottom seal (or lap seal) now formed, is then further pulled downstream with tractive force by vacuum infeed conveyor F. The now-continuous bottom-sealed tube then enters the vertical seal modular assembly G, here shown for simplicity without the auxiliary equipment housing, protective covers and shields.

Figure 3:
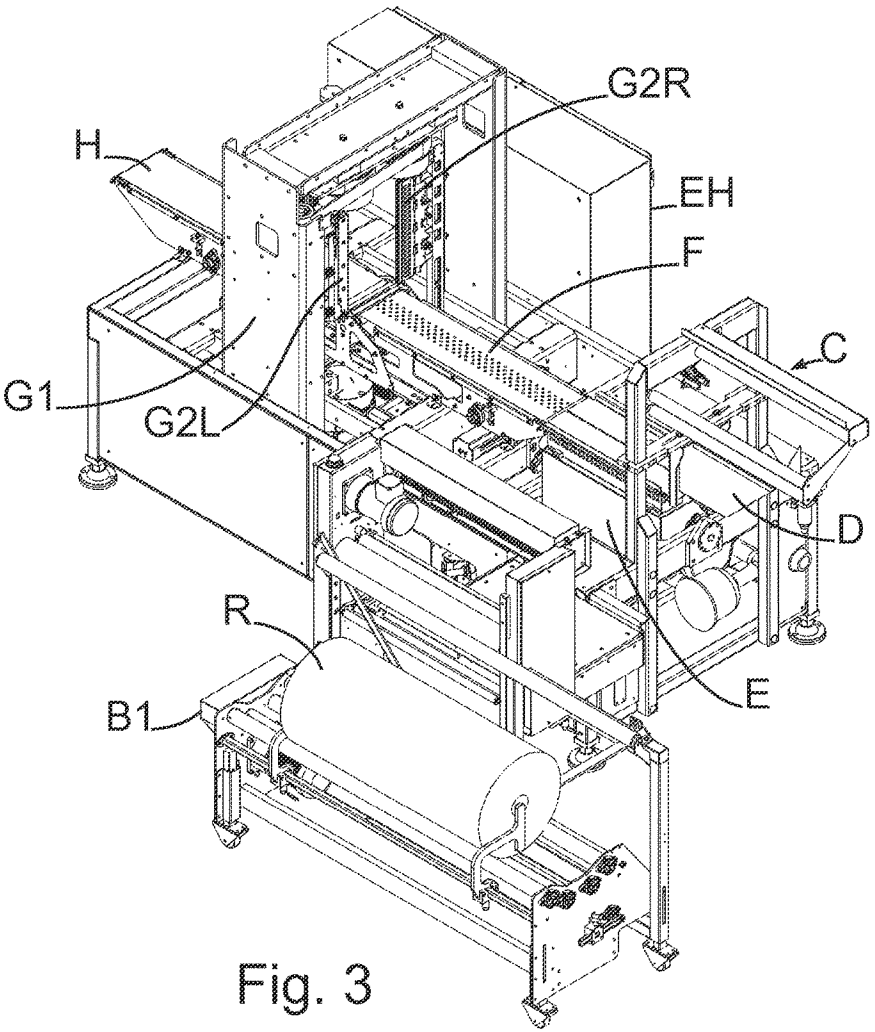
FIG. 3 is the same perspective view of the machine shown in FIG. 1 except that covers and hoods have been removed to show internal mechanisms.
Figure 4:
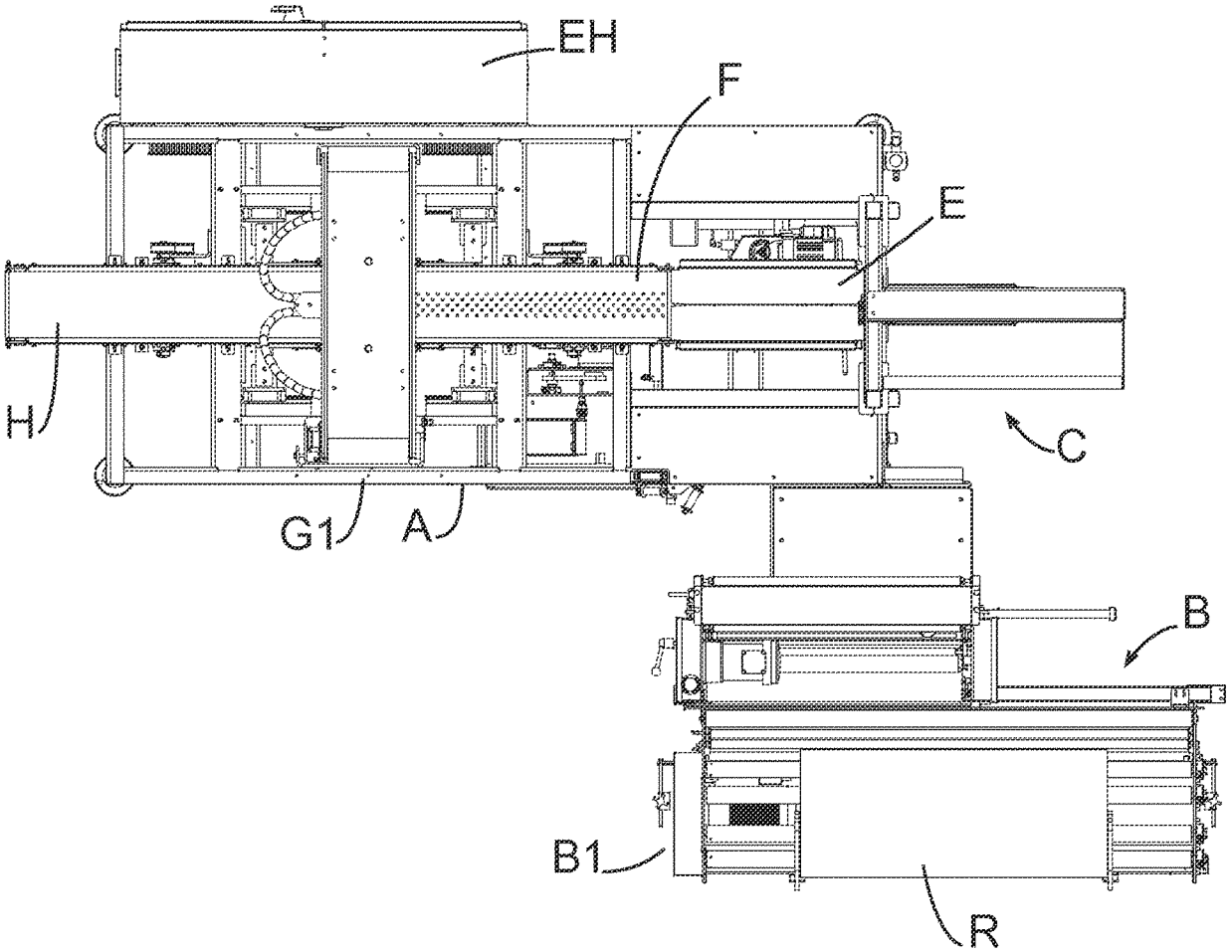
FIG. 4 is a top view of the machine of FIG. 1.
Figure 5:
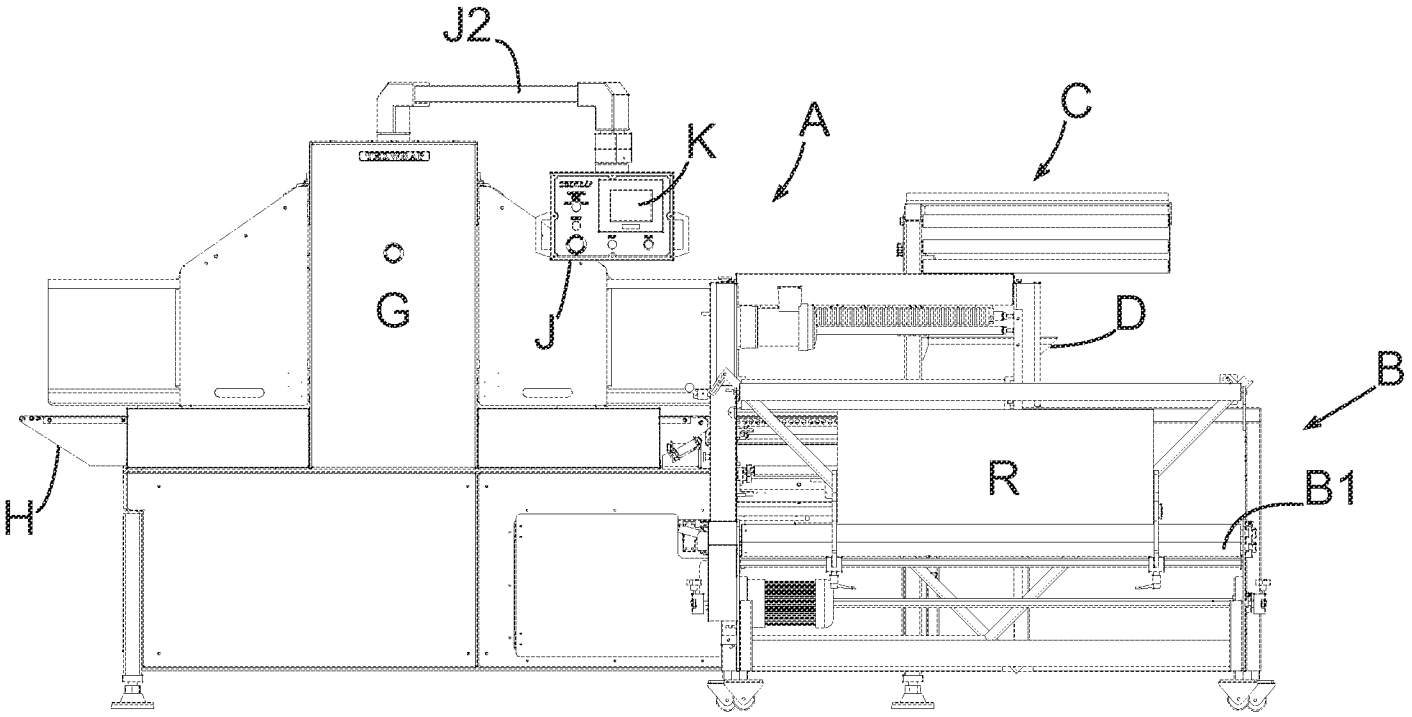
FIG. 5 is a side elevation view of the new film wrapping machine showing relative placement of some of its larger features, with covers and hoods shown in place.
Figure 6:
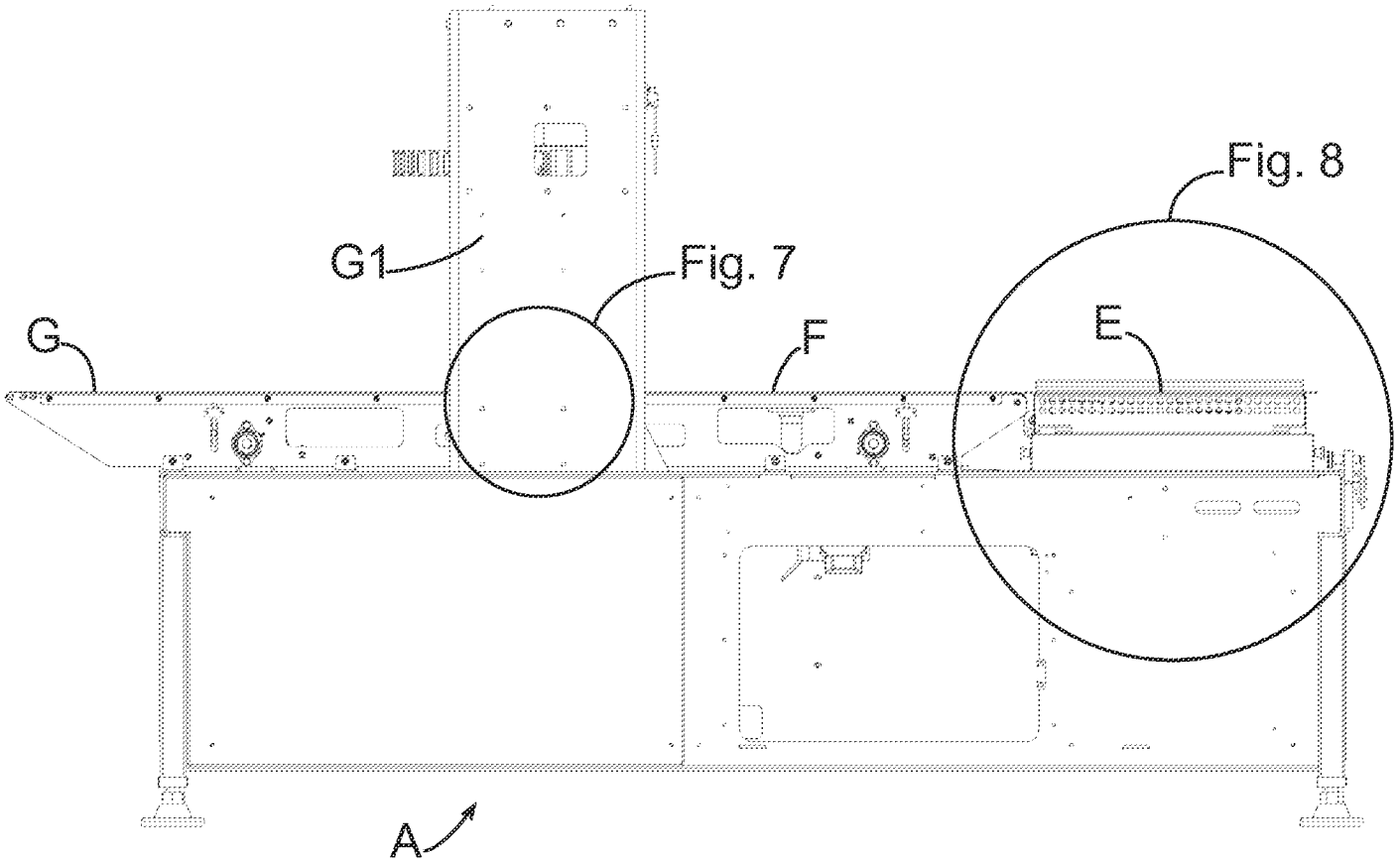
FIG. 6 is a side view of portions of the new machine, where covers and hoods have been removed to show mechanisms, and relative placement of the bottom seal unit E and portions of the infeed and outfeed conveyors within the machine.

In FIG. 3 there is designated at EH an equipment housing for auxiliary equipment and control wiring components. To simplify illustration of other operational features, housing EH is not shown in some other views.

Sealing assembly G includes a vertical frame extension G1 in which are heated sealing jaws G2L and G2R (see also FIG. 10) that make up a vertical rotary-motion sealing knife jaw system with independent temperature controls for independently heating and controlling sealing surfaces of the jaws. The features of the sealing jaw system, including its rotary actuation, can be seen in FIGS. 3 and 10, in which the jaws are shown in open position. Above and below the jaws are top and bottom planetary gearheads G3L and G3R that carry the jaws, that is, sealing heads, which are pivoted for movement on an axis eccentric to that of the gearheads, so that the heads always face each other, but providing orbital movement toward and away from tube-enveloped products as well as movement along with the tube-enveloped products so that the heads travel a distance in an opposed sealing relation as the tube of products moves through the machine. This provides during sealing an appropriate sealing "dwell time" during which sealing between successive packages occurs. The sealing dwell time is that period from the start of sealing engagement with the tube surface until the mechanism pulls the sealing jaws away from contact and returns them with orbital movement to reposition them for a new sealing engagement. The orbitally-reciprocating sealing heads G2R, G2L accordingly move through an elongated orbit so that these operations take place "on the fly" for attaining high speed operation with outstanding throughput, and not requiring stopping of the conveyor system as sealing and cutting occurs "on the fly." This rotating orbital operation is to be distinguished from known prior sealing arrangements in which (a) sealing heads either simply move laterally inward for sealing and laterally outward to a wait position until moved inward; or (b) sealing heads simply rotate about an axis that does not shift, as they move between sealing position and wait positions; or (c) sealing heads move downwardly for sealing, although possibly moving with the packages and then upwardly and then returning to a position for a successive sealing operation; or d) conveying is halted while sealing and cutting take place.

Figure 10:
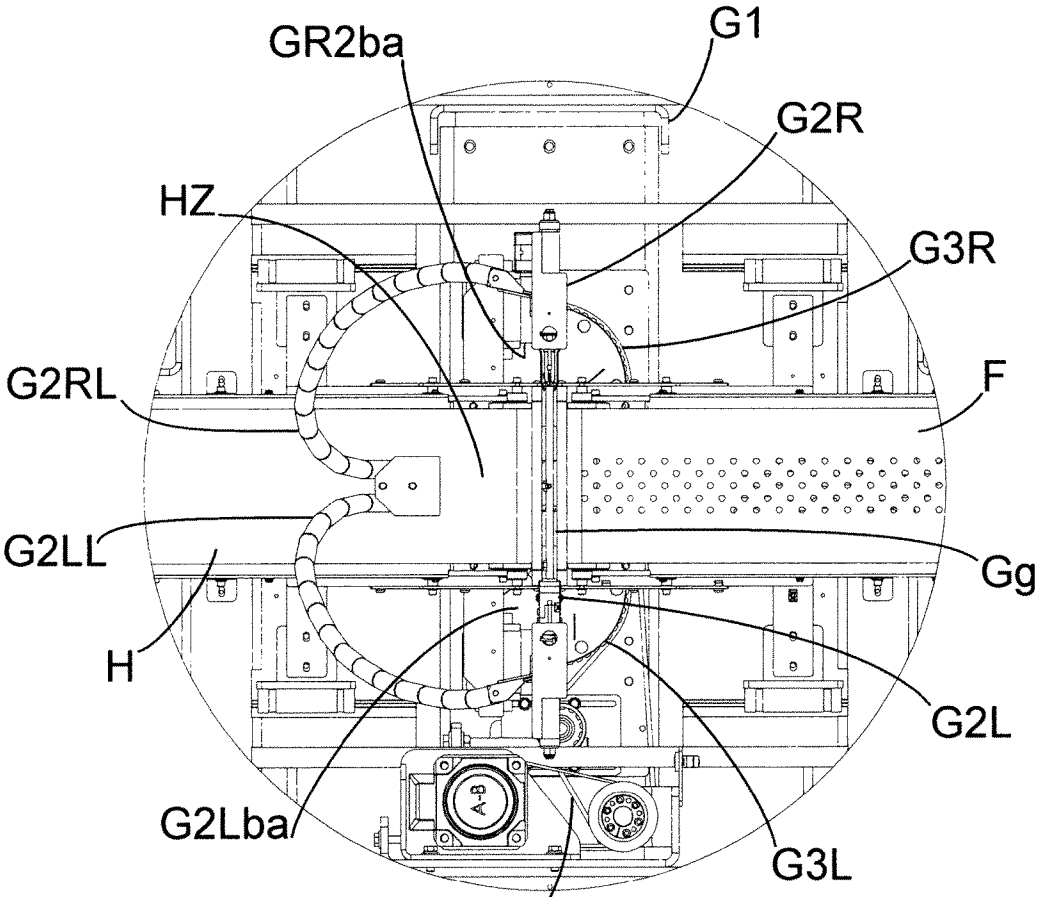
FIG. 10 is a view within the vertical seal unit, as taken according to the indication in FIG. 9.

To provide the movement described above in this high-speed vertical, upright package sealing operation, shown representatively at G4 is a gearhead drive belt suitably driven by a motor, such as a stepping motor or servo motor, of the new machine. The jaws, as for example G2L, are preferably provided with a spring bed cushion mounting system in association with an independent temperature control. Therefore, the spring bed cushion mounting provides for resilient engagement of the film tube during a sealing movement of the jaws, and with sealing taking place at a preselected sealing temperature of the sealing surfaces of the jaws. Although only the lower set of gearheads is shown in FIG. 10 or elsewhere, the gearhead of the same type and operation are provided at both the upper and lower ends of the sealing jaws. These gearheads provide for rotation on a vertical axis, that is, vertically perpendicular to the vacuum conveyor F and the tube-enveloped vertical products, so that the orbital movement of the jaws occurs within a horizontal plane. Gearhead circular rotation causes each sealing jaw assembly thereby to move in an orbital path toward and away from the film-enveloped packages, and as explained, along with the moving tube and products, to make possible continuous-operation sequential vertical sealing between each selected vertical package or group of vertical packages. For example, a vertical seal can be made between adjacent packages, or between a group of packages (such as, only as an example, four in number).

Figure 13:
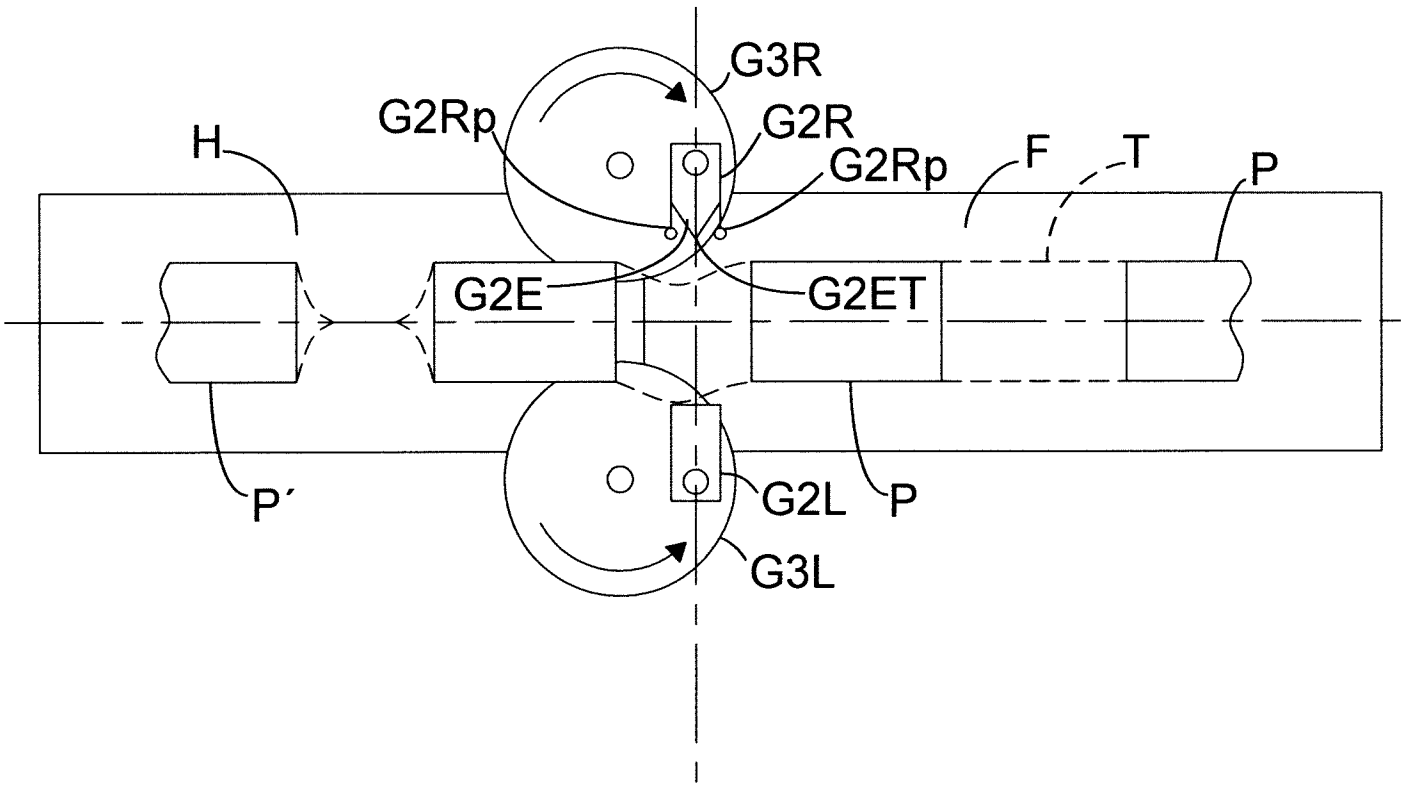
FIGS. 13, 14 and 15 are a sequence of plan views of the sealing sequence carried out during operation of the machine of FIG. 1.

Referring to FIG. 10 and now also to FIG. 13, A sealing knife or blade edge G2E forms a blade apex of preferably 60 degrees angular extent such that the apex or knife tip G2ET can be protected by small transition roller projections G2Rp at opposite blade faces providing for transition and sealing penetration as the jaw assembly closes against a lateral face of the product-filled film tube for sealing. The tip G2ET protrudes beyond the converging blade surfaces, and presents a protruding heater surface, i.e., protruding beyond the converging blade surfaces to ensure proper application of heat for sealing sufficiently as to ensure cutting with sealing as the lateral tube surfaces are, in effect, pinched together by action of the sealing knife.

In addition, adjacent to the apex or knife tip is an air jet outlet nozzle Gjo (also shown in FIG. 7), that is provided with air timed and pressured sufficiently to blow a puff of air at the film so as to ensure that a clean "cut" is produced by the sealing knives and so that at the opposite end edges no objectionable dimple, film pocket, gusset, "ear" or "tuck" is formed, resulting in a smooth, clean seal.

Figure 8:
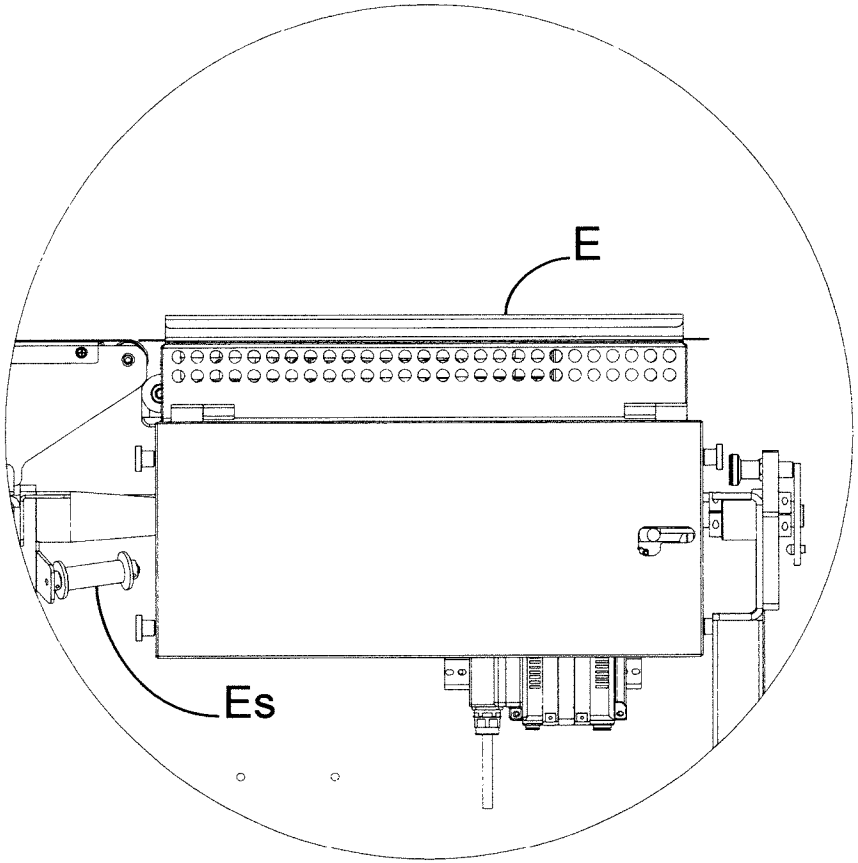
FIG. 8 illustrates the placement and relative location of the bottom seal unit, and its provision for diversion of a waste trim strip, as the view is taken according to the indication in FIG. 6.
Figure 11:
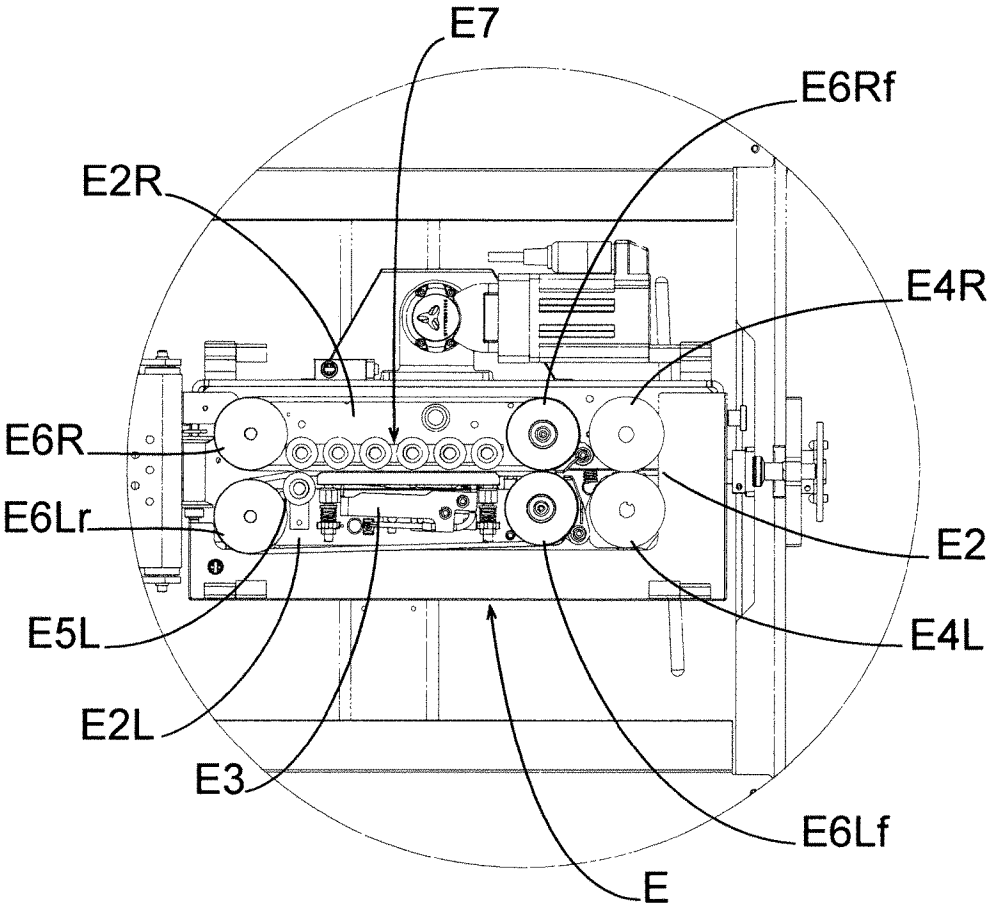
FIG. 11 is a view of elements with the bottom seal unit with its cover removed.

Consider now the bottom seal module E shown in greater detail in FIG. 11. Modular sealer apparatus E produces a bottom seal by pulling film material into the new automated sealer and by cutting and sealing opposing surfaces of the film material so they are bonded together by application of heat and pressure applied on opposing surfaces of the film material as the film-wrapped articles are sequentially pulled by the modular sealer through the modular sealer. The modular sealer both cuts and seals the joined margins, i.e., opposing surfaces, as the film-wrapped packages pass over the modular sealer and with margins being pulled into confronting surfaces of the sealer. The modular sealer is also used to trim away excess overlapping film from tube edges as the tube enveloping the packages is formed. An excess (waste) trim strip of film material is cut, being the narrow scrap portion of the film material which is cut from the formed bottom seal, and is carried away from the conveyor as a minimum amount of waste trim. A diverter spool Es shown in FIG. 8 provides for diversion of the waste trim strip.

Referring to FIG. 11, modular bottom sealer E features are shown in greater detail. Movement of product into the forming tube is from the right side of the sheet having FIG. 11, as according to the infeed indication shown in FIG. 1. Sealer E has a chassis E2 that has left and right belt-and-pulley sections E2L and E2R, where now it is understood that "left and right" refer to the sides of the infeed axis. Normally, sealer E is centrally aligned with the infeed axis so that bottom seals will be formed with central alignment below packages as they travel into the apparatus along the infeed axis, but the bottom sealer lateral positioning can be selectively varied by adjustment during setup for lateral selection of the desired bottom seal.

A heated blade assembly E3 of the left-hand section cuts the film material and cooperates with right and left twin belt assemblies of belt-and-pulley sections E2L and E2R, which provide clamping pressure to laterally clamp opposed edges of the tube of film material for the purpose of bottom sealing of the film material.

More specifically, associated with each of these right and left belt-and-pulley sections is a respective upstream nip roller E4L and E4R driven by the gear train. The nip rollers E4L and E4R, which also may be referred to as lag rollers or traction rollers, are in opposed relation and located proximate a lateral edges of the overlapped film material for tightly gripping between them the unbonded overlapped shrink film material as it is drawn into a tube through the modular sealer and passes through a nip space tightly defined by pressure of the opposed nip rollers. Such rollers are of resilient urethane rubber and serve to provide sufficient traction for pulling the overlapped film material into the modular sealer.

The traction or so-called nip rollers are carried by respective parallel axles, which are here evidenced by the center of rollers E4R and E4L. The right axle is biased suitably by spring pressure toward the left axle so that the nip rollers together provide said tightly gripping relation of the unbonded overlapped shrink film material for pulling the film material into the belt-and-pulley sections. A suitable limit switch may be provided, as by shifting of one of the axle shafts of the nip rollers, to interrupt packaging machine operation and so also interrupt mechanical operation of the apparatus if excessive force tending to separate the nip rollers would occur, such as a result from undesired bunching of film material or if an unwanted or improper object or misaligned package is pulled with the film to the modular sealer with film pulled by the nip rollers.

The belt-and-pulley sections E2L and E2R, provide pairs of parallel belts on each side, as designated E5R and E5L, which bear against the film material and these belts are V-belts, having a V-shaped inner surface and a flat outer surface and run between upstream and downstream sets of V-groove pulleys E6R, E6Rf, E6Lf and E6L, there being opposite end pulleys E6Rf and E6Lr. The belts are oriented so that flat of each of the V-belts are pressed in clamping relationship against the upper face of the upper sheet of film material.

From the above description, it will be seen that the right and left belt-and-pulley sections E2R and E2L are on opposite sides of the lapped film material to provide sealing pressure by cooperating with heated blade assembly E3 and, additionally it will be seen that the right belt-and-pulley section E2R also has a series of idler pulleys, here shown as six in number, and designated generally E7, which provide additional pressure along the right side opposite from the heated blade assembly E3.

A narrow elongate space, i.e., a narrow gap, is defined between the two left-hand belts. This space, not here visible, is defined by the V-belt pulley grooves, is selected to be just adequate for receiving the heated blade assembly E3, which includes a heated element that extends slightly into narrow elongate space between the lower belts for thermal cutting of the film material film. The heated blade assembly extends from the space between the upper V-belts into the space between the lower V-belts with a very shallow pitch angle, but in so doing will be such as to cut through and pass thereby through the plane of the layered film material which it cuts by melting. Specifically, The heated blade assembly comprises an electrically resistive element therein and has temperature sensor therein for sensing temperature of the blade assembly, which is maintained at a desired temperature by control monitoring of the temperature sensor.

The heated blade assembly is provided with a release coating of zirconium nitrate. Although conceivably other release type coatings, such as "Teflon" ® fluoropolymer material, could be used, or so also silicones or fluorosiliconized films, the preferred zirconium nitrate is desirably smooth and highly resistant to scratching, being among the hardest manmade surfaces practically available. This resistance to scratching is highly desirable, as the modular sealer may be handled for cleaning and adjustment. It is desired that any normal manipulation or abrasion occurring during such handling or cleaning would otherwise disturb or scratch the release coating.

The resistive element is supplied with electrical power at what is customarily referred to as 220 VAC potential. So-called 220 volt wiring in the U.S.A. provides voltage supplied from a transmission or local source at nominally 240 volts in the U.S.A., although actual voltage may depend on premises wiring. It is customary to refer to this level of a.c. electrical power as "220 volt power" or "220 volt service" and that terminology is here used. Voltage at that level allows sufficient power flow to the heated blade assembly so that it is be maintained at such temperature or temperature range when the modular sealer is used for cutting and sealing a wide variety of types and thicknesses of film materials, and without the sealing and packaging functions of the machinery being limited any thermal insufficiency. The average temperature preferably may approximate 350 degrees F. (about 175 degrees C.) in the cartridge heater itself, so that resultant temperature of the surface may approximate about 300-350 degrees F. (about 149-177 degrees C.) as a general preference During operation, the blade assembly remains heated even if operation is halted, as by a jam or fault, without causing damage to upstream or downstream film material, as it has already cut away film material up to the point of machine operation being halted. Modular sealer E, with its twin belt assemblies of belt-and-pulley sections and so also tractor (or so-called nip) rollers, is driven mechanically and synchronously with the new high speed packaging machine, with drive energy supplied by electric or mechanical servo drives, e.g., of pneumatic or hydraulic type, or by being interlinked, as by chain drive, drive belt, shaft drive, or synchronized motors, with other drive components of the new high speed film wrapping machine. The modular sealer, with its twin belt assemblies of belt-and-pulley sections and so also tractor (or so-called nip) rollers, is driven mechanically and synchronously with the new high speed packaging machine, with drive energy supplied by electric or mechanical servo drives, e.g., of pneumatic or hydraulic type, or by being interlinked, as by chain drive, drive belt, shaft drive, or synchronized motors, with other drive components of the new high speed film wrapping machine.

The modular bottom sealer E has wide adjustability for use in many different situations. It operates with reliability and over a possible wide range of speeds, including high speed or low speed, and be able to be carried out over a wide range of materials such as those noted, and without frequent attention after it has been satisfactorily established for use with a given type and composition of film. Sealer module E is relatively maintenance free for continuous operation over long periods of time.

Figure 7:
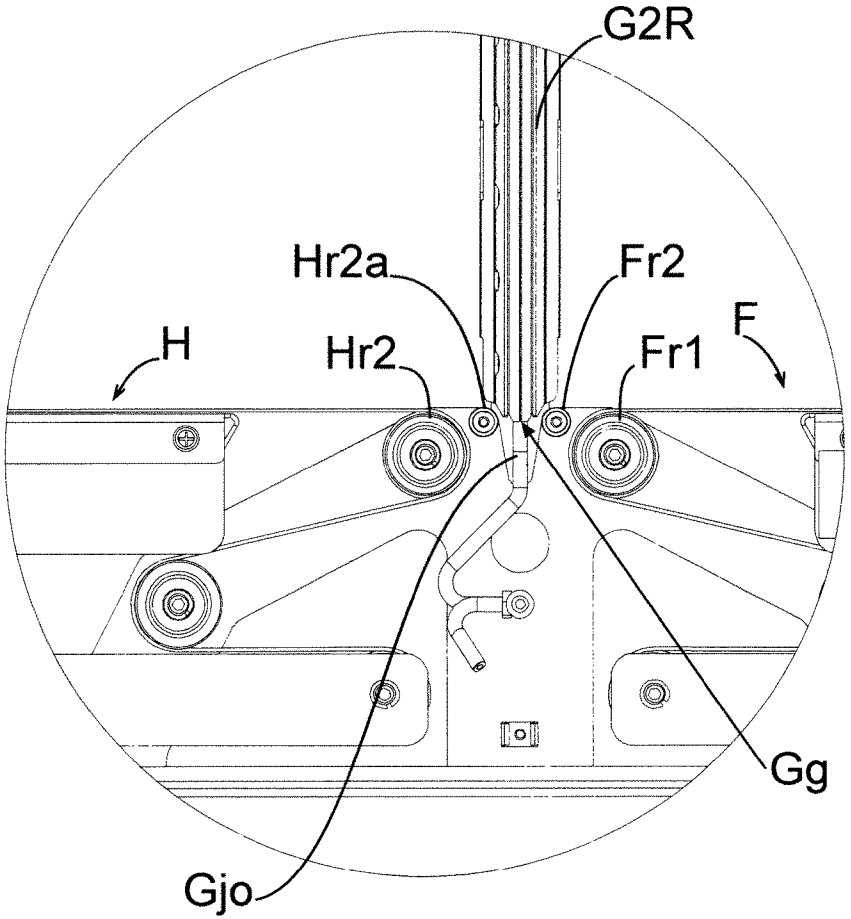
FIG. 7 is a partial interior view of the sealing mechanism and relative location of sealing components as well as rollers and auxiliary rollers providing certain advantages during sealing, taken according to the indication in FIG. 6.

Referring to FIG. 7, and so also FIG. 10, a vertical cross section of the vertical sealing and cutting section G1 (FIG. 10) shows heated sealing jaws G2R which is intermediate between the infeed conveyor F and outfeed conveyor H, respective driven by belts passing over main rollers Fr1 and Hr1. Small auxiliary rollers Fr2 and Hr2*a*] bring a support surface of the respective conveyor very close to the sealing jaws to provide only a small gap Gg between the infeed and outfeed conveyors, and over which over which the tube containing products will pass. As will be understood, the sealing jaws close upon the tube and follow it for a distance as sealing occurs, before returning in cyclic manner to the position shown. Below the lower edge of each of the heated sealing jaws, observe an air jet outlet Gjo which serves to direct a puffed jet of air to the tube as the sealing jaws close upon it, serving to prevent objectionable dimples, film pockets, gussets, "ears" or "tucks" during sealing. The timing and duration of the puff or puffs is selected to cause the film material to be pressed against the products enclosed in the tube, and occurring at the time or times found to provide optimum results, and prevents film material from entering space between the infeed and outfeed conveyors. The result in a tight, neat corner for sealed packages, as shown in FIG. 12, a view of a representative sealed package P' having several products P1-P3 which have been wrapped and sealed within the package as they passed in vertical orientation through the machine, and where such a corner is designated Pc. Neat, smooth corners result at both ends of the package P'.

Figure 9:
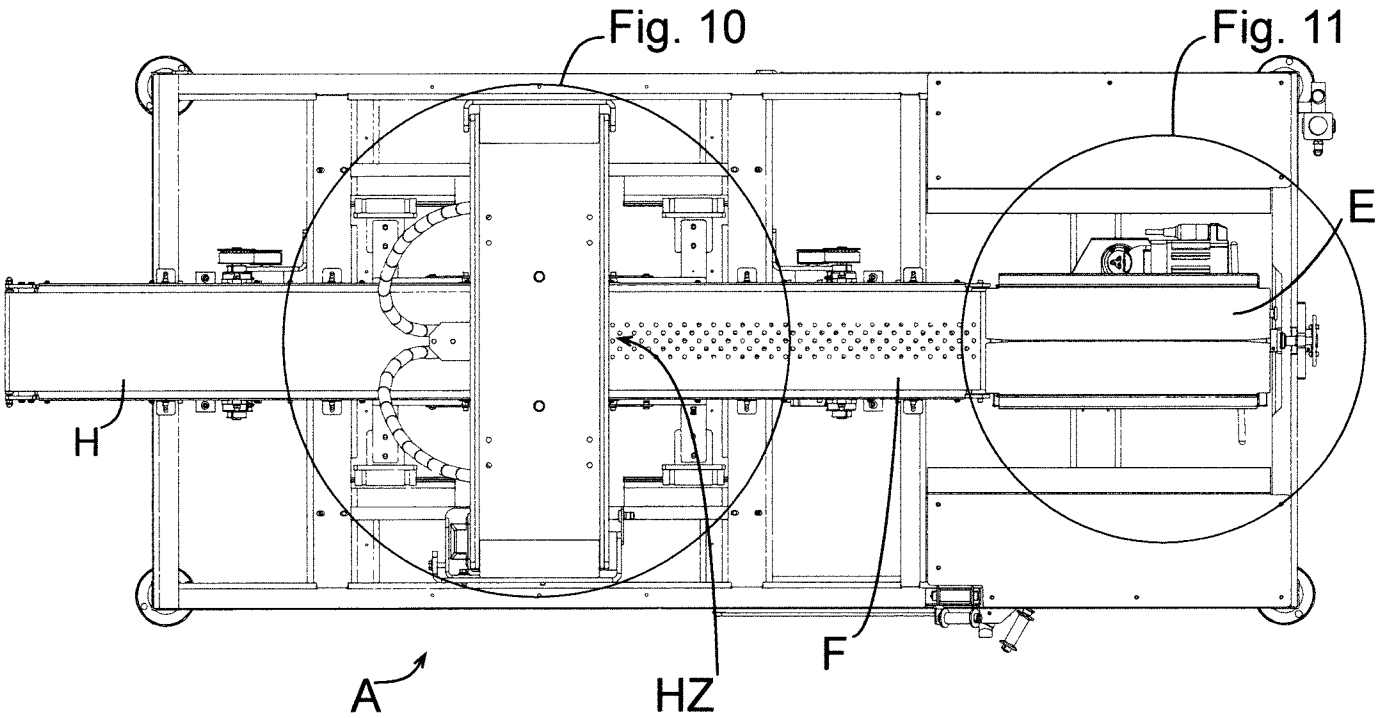
FIG. 9 is a top plan view of portions of the above-mentioned infeed and outfeed conveyors, the vertical seal unit enclosure and the bottom seal unit.

Refer then to FIGS. 9 and 10 to see features of the right and left sealing jaws G2L and G2R in their resting positions on opposite sides of the sealing path, formed by infeed conveyor, which is provided with apertures Fa by which a partial pressure, referred to as vacuum, is maintained to hold shrink tubing with products therein against the surface of the infeed conveyor for positive conveyance into the heating zone HZ in which the sealing jaws move during sealing of products within the tube. Electrical leads for electric heating of the sealing jaws are designated at G2RL and G2LL. Lower are evident in the view, and are representative also of comparable upper planetary gearheads, it being understood that the sealing jaws are pivotally mounted thereto at top and bottom. Sealing jaws G2L and G2R have respective blade assemblies G2Rba and G2Rba, and the latter is preferably V-shape for impingement against the former, which is comparatively flat shaped, so as to provide a clean thermal cutting relationship as the blade assemblies close on the tube with products therein. The V-shape (i.e. blade apex-forming) and flat shape character of the sealing surfaces of the sealing jaws is emphasized in FIGS. 13-15.

The new shrink-wrap machine provides for driving the right and left sealing heads or jaws by maintaining each with a circular movement relative to a vertical axis, which is perpendicular to the direction of movement of products moving along infeed conveyor F. The heads are each maintained at a fixed angle of orientation. That is, they always are in mutually facing orientation. The arrangement provided by the planetary gearheads G3L and G3R is such that the oppositely disposed sealing heads travel mutually toward and away from each other as each as they in a closed geometric path, defined by the axial pivotal securement of the sealing heads to the gearheads, which define a circular path for the pivots.

Figure 14:
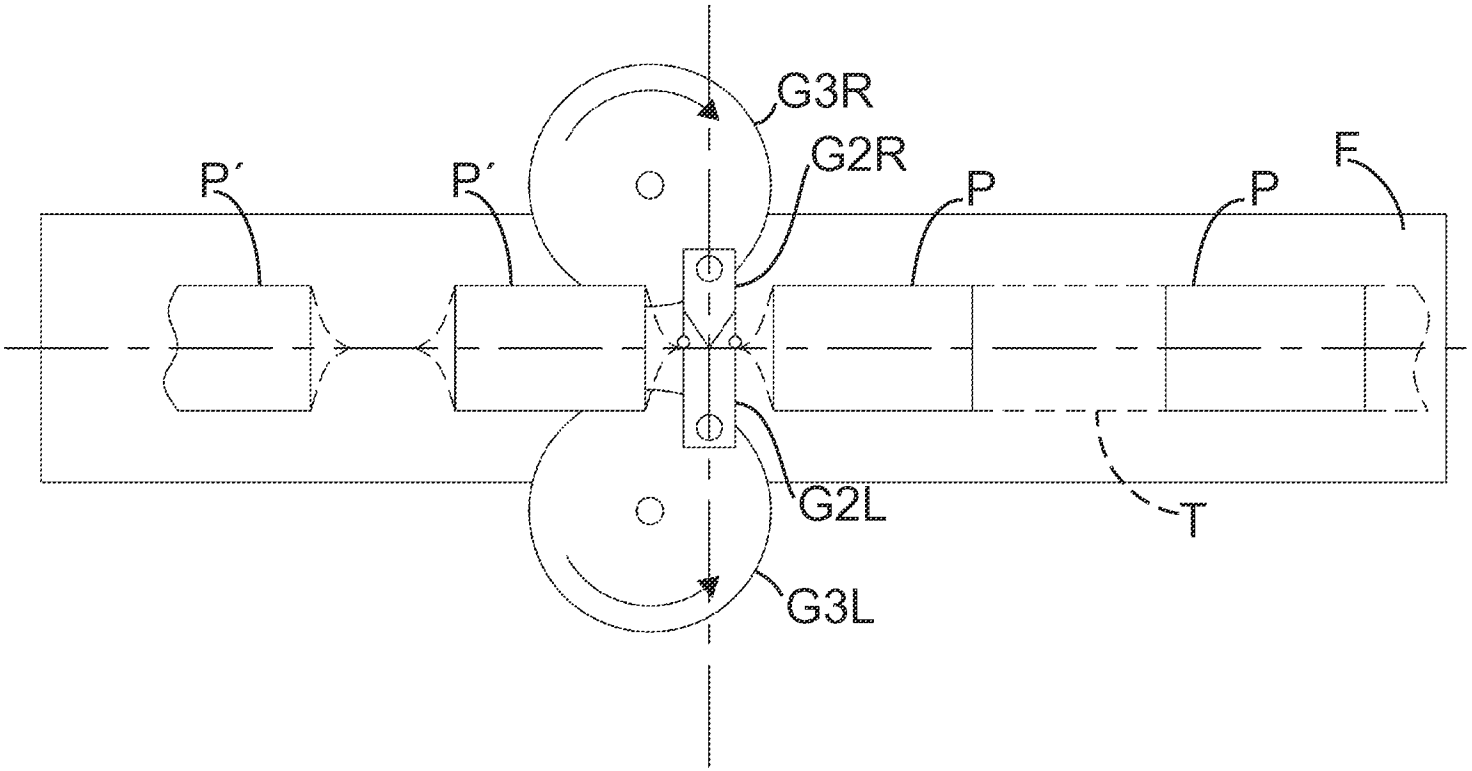
Figure 15:
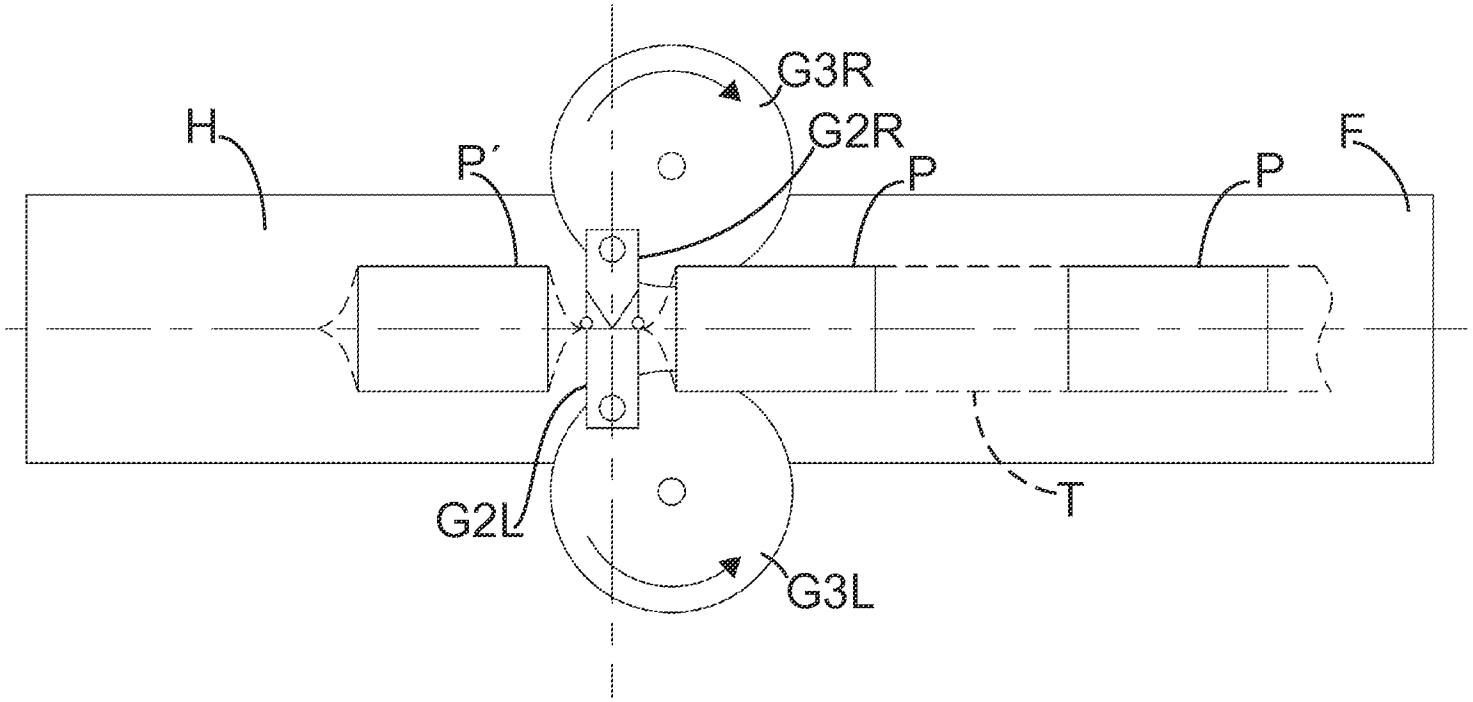

Thus, FIGS. 13-15 now demonstrate the sequence of sealing steps as the film tube T moves through the new machine for sealing of packages P therein. During operation, the planetary gearheads G3L and G3R carry the respective sealing heads G2L and G2R in an epicyclic sequence of motion, shown beginning in FIG. 13, progressing to a sealing initiation of impingement in FIG. 14, and then continuing as in FIG. 15 to show how the sealing heads G2L and G2R move for distance with packages P for causing thermal melting of the film material of tube T. The operation provides separated packages P' which move along the output conveyor H for delivery in package-separated condition, and generally conforming, for example to the completed package shown as P' in FIG. 12. As the sealing is completed and separation of the film occurs, gearheads G3L and G3R further rotate from the position of FIG. 15 to carry their sealing heads G2L and G2R back to starting position shown in FIG. 13. Of course, the triple-pack shown in FIG. 12 is but one example of vertical packaging. The new machine may have timing selectively varied under computer control, determined by setting of operator control module J by which software operation is set up. Movement of packages is not interrupted during sealing and cutting of the formed tube T enveloping the packages, because sealing and cutting is carried out by the orbitally-reciprocating sealing heads G2R and G2L so that these operations take place "on the fly" for attaining high speed operation with high product throughput.

A further preferred sealing head feature evident in FIGS. 13-15 is seen to film clamping roller projections G2Rp that extend along a vertical portion of the sealing head G2R, on opposite sides of the generally V-shaped (i.e., blade apex-forming) sealing surface, and serving to clamping press film material of tube T more securely against the generally flat sealing surface of sealing head G2L, as sealing is initiated and is carried out in moving from the position of FIG. 13 to the position of FIG. 14.

In general, the various metal components of the modular sealer, except as described otherwise, may be of machine steel, or suitable alloy such as stainless steel or an aluminum alloy. Shaft bearings may be of various types forms such as roller, needle, or Teflon™, or brass.

As various modifications could be made in the constructions and methods described and illustrated in this document without departing from the scope of the invention, it is intended that all matter contained in the foregoing description or shown in the accompanying drawings shall be interpreted as illustrative rather than limiting.

Accordingly, the breadth and scope of the present invention should not be limited by any of the above-described exemplary embodiments, but should be defined only in accordance with the claims and their equivalents.

What is claimed is:

1. A wrapping machine for on the fly sequentially wrapping upright products delivered sequentially by a loading device, the machine comprising:

a sealing and cutting station module;

a wrapping station module upstream of the sealing and cutting station module;

a source of rolled film material delivered as a web to the wrapping station module;

the wrapping station module forming the web about the products to envelope the products in a tube;

a bottom seal module operating to join marginal edges of the film material so as to create only a continuous longitudinal bottom seal of the tube;

a conveyor for moving tube-enveloped products toward the sealing and cutting station module by vacuum conveyor tractive adherence to the tube;

the sealing and cutting station module comprising opposed sealing and cutting heads with upright sealing surfaces, the sealing and cutting heads being pivotally carried at opposite lateral sides of the tube within the sealing and cutting station module by drives such that the sealing and cutting heads face each other during sealing and cutting and move laterally inwardly across a width of the vacuum conveyor toward each other and in alignment with a gap in the conveyor for sealing and cutting, with a lower edge portion of each sealing and cutting head extending downward within the gap, the sealing and cutting heads providing orbital movement toward and away from the tube-enveloped products from opposite sides together with movement along with the tube-enveloped products so that the sealing and cutting heads travel a longitudinal distance in an opposed lateral sealing relation as the tube with products enveloped therein moves through the sealing and cutting station module, giving sealing dwell time during which sealing and cutting between successive products or groups occurs on the fly without interruption of movement of the products during sealing and cutting, wherein the sealing and cutting station module further comprises an air nozzle connected to an air source, the air nozzle located within the gap and below the lower edge portions of the sealing and cutting heads to blow a puff or puffs of air upward to cause the film material to be pressed against the products enclosed in the tube to limit film material from moving down into the gap.

2. A film wrapping machine as set forth in claim 1 further comprising a microprocessor-driven control system having viewing and controlling controls for controlling operation of elements and modules of the film wrapping machine.

3. A film wrapping machine for sequentially wrapping upright products that are delivered sequentially to the machine, while the products remain upright, the machine comprising:

a sealing and cutting station module;

a wrapping station module upstream of the sealing and cutting station module;

a film supply station module that supplies a continuous web of film material to the wrapping station module, the film material being heat shrinkable film;

a tube former at the wrapping station module for receiving the web of the film material from the film supply station module so as to form a continuous tube of the film material that envelops the upright products as they are delivered sequentially;

the tube former causing margins of the film material to be brought together below the upright products as they are delivered;

a bottom sealer carried beneath the wrapping station module to produce a longitudinal bottom seal from the margins of the film material;

a conveyor arrangement that, while a product or group of products are enveloped in the continuous tube, moves tube-enveloped products toward the sealing and cutting station-module and then out of the sealing and cutting station module, the conveyor arrangement including an infeed conveyor and an outfeed conveyor, with a gap between the infeed conveyor and the outfeed conveyor, the gap aligned with the sealing and cutting station module;

the sealing station module having laterally opposed upright sealing heads, each upright sealing head having a lower edge portion that extends down into the gap, wherein the upright sealing heads move laterally across a width of the conveyor in alignment with the gap toward and away from the products to seal the film material between adjacent products or groups of products as the tube-enveloped products move through the sealing station module without requiring halting of movement of the tube-enveloped products, and with said sealing being carried out to cause cutting of the film material between the products or groups of products enveloped in the continuous tube so that wrapped products or wrapped groups of products are separated into separate film wrapped products or film-wrapped groups of products; and wherein the sealing station module further comprises an air nozzle connected to an air source, the air nozzle located within the gap to blow air upward to cause the film material to be pressed against the products enclosed in the tube to limit film material from moving down into the gap, whereby products, as oriented upright, become fully enclosed within the film material and remain upright as they are conveyed and packages of the products are delivered without stopping during sealing and cutting of the film material.

4. A film wrapping machine as set forth in claim 3 further comprising a microprocessor-driven control system having viewing and controlling controls for controlling operation of elements and modules of the film wrapping machine.

5. A film wrapping machine as set forth in claim 3, wherein the laterally opposed upright sealing heads are pivotally carried such that the upright sealing heads face each other with fixed angular orientation, the sealing station module providing orbital epicyclic movement of the upright sealing heads toward and away from the tube having products enveloped therein with movement along with the tube-enveloped products with the result that the upright sealing heads travel a distance in an opposed sealing relation as the tube with products moves giving sealing dwell time during which sealing and cutting between successive packages occurs by thermal melting of the film material of the tube, without requiring halting of movement of the tube and tube-enveloped products.

6. A film wrapping machine as set forth in claim 3, wherein a first one of the upright sealing heads has a sealing surface forming a blade apex, an opposed second one of the upright sealing heads has a sealing surface opposed to the sealing surface of the first upright sealing head, the first and second upright sealing heads closing during operation against lateral faces of the product-enveloping tube as it passes through the sealing station module, the first s upright ealing head sealing surface having a protruding heater surface by which said sealing and cutting between successive packages occurs by thermal melting of the film material of the tube when the first and second upright sealing heads are closed upon lateral faces of the product-enveloping tube.

7. A film wrapping machine as set forth in claim 6, wherein said blade apex is a knife edge, the knife edge being protected by small transition rollers on opposite faces of the blade apex for transition and sealing penetration when the first and second upright sealing heads are closed upon lateral faces of the product-enveloping tube.

8. A wrapping machine for on the fly sequentially wrapping upright products passing through the machine, the machine comprising:

a sealing and cutting station;

a wrapping station upstream of the sealing and cutting station;

a source of rolled film material delivered as a web to the wrapping station, the wrapping station forming the web about the products to envelope the products in a tube;

a bottom sealer operating to join marginal edges of the film material so as to create a continuous longitudinal bottom seal of the tube;

a conveyor arrangement for moving tube-enveloped products into and out of the sealing and cutting station and having an infeed conveyor and an outfeed conveyor, with a gap between the infeed conveyor and the outfeed conveyor;

the sealing and cutting station comprising opposed upright sealing and cutting heads with upright sealing surfaces, the upright sealing and cutting heads being pivotally carried at opposite lateral sides of the tube by drives such that the upright sealing and cutting heads face each other during sealing and cutting and move laterally inwardly across a width of the vacuum conveyor toward each other and in alignment with a gap in the conveyor for sealing and cutting, with a lower edge portion of each sealing and cutting head extending downward within the gap, the sealing and cutting heads providing orbital movement toward and away from the tube-enveloped products from opposite sides together with movement along with the tube-enveloped products so that the heads travel a longitudinal distance in an opposed lateral sealing relation as the tube with products enveloped therein moves through the sealing and cutting station, wherein the sealing and cutting station further comprises an air nozzle connected to an air source, the air nozzle located within the gap and oriented to blow air upward to cause the film material to be pressed against the products enclosed in the tube to limit film material from moving down into the gap.

9. A wrapping machine as set forth in claim 8 further comprising a microprocessor-driven control system having viewing and controlling controls for controlling automatic operation of machine elements and modules.

* * * * *